350-437 SR
XR 4,167,333
CROSS REFERENCE

United Sta
Young et al.
[11] 4,167,333
[45] Sep. 11, 1979

SEARCH ROOM

[54] AUTOMATIC DISTANCE COMPENSATING SIGHT AND PROCESS OF SIGHTING

[76] Inventors: James E. Young, 18290 SE. 370th, Sandy, Oreg. 97055; George O. Cushman, deceased, late of Boring, Oreg.; by Ruth N. Cushman, executrix, 33333 SE. Brooks Rd., Boring, Oreg. 97009

[21] Appl. No.: 748,934

[22] Filed: Dec. 9, 1976

Related U.S. Application Data

[63] Continuation-in-part of Ser. No. 578,530, May 19, 1975, abandoned.

[51] Int. Cl.[2] ..... G02B 27/00
[52] U.S. Cl. ..... 356/247; 33/265; 350/194; 356/253
[58] Field of Search ..... 356/247, 253, 254, 20, 356/21; 350/189, 194, 213; 33/265, 233

[56] References Cited

U.S. PATENT DOCUMENTS 1,982,489 11/1934 Wilcox ..... 33/265 X
3,137,755 6/1964 Smith ..... 356/254

FOREIGN PATENT DOCUMENTS 285718 7/1914 Fed. Rep. of Germany ..... 356/247

*Primary Examiner*—John K. Corbin
*Assistant Examiner*—Matthew W. Koren
*Attorney, Agent, or Firm*—Eugene M. Eckelman

[57] ABSTRACT

A sighting lens has a refraction displacement of the image such that upon selected positioning of the lens on a weapon, such as an archery bow, and using a reference point therewith, a novel sighting procedure for hunting animals can be used which comprises aiming a selected distance below the image of the animal as it appears in the lens. Prisms are included to correct the line of sight which may not be true because of offset mounting of the sighting device. Increments of distance are provided on the lens for assisting the archer in aiming at a distance which is beyond normal shooting limits of that particular sight.

8 Claims, 16 Drawing Figures

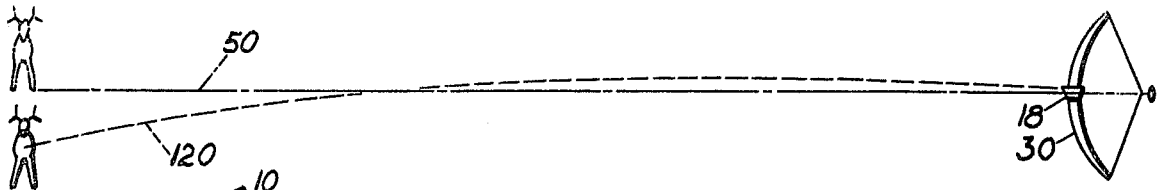
FIG. 1
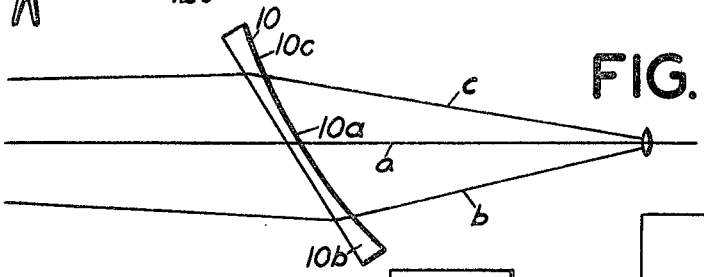
FIG. 6
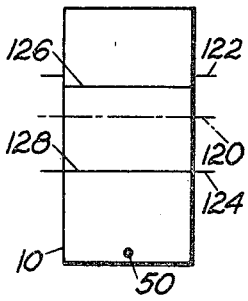
FIG. 5
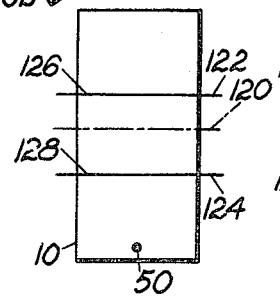
FIG. 4
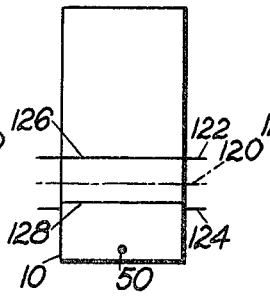
FIG. 3
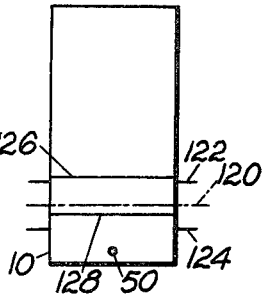
FIG. 2
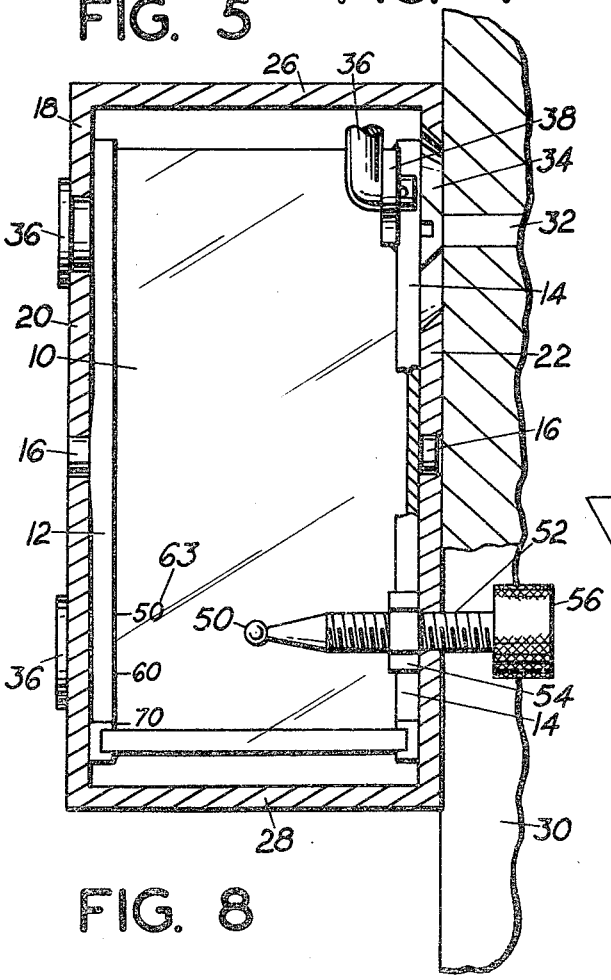
FIG. 8
FIG. 7
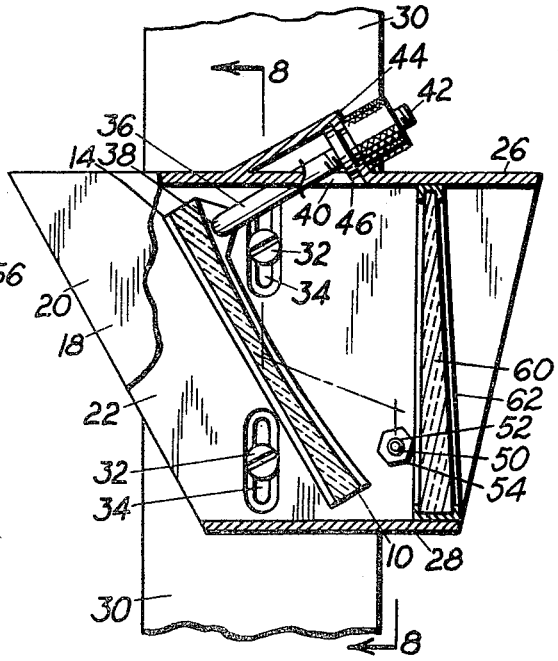

AUTOMATIC DISTANCE COMPENSATING SIGHT AND PROCESS OF SIGHTING

REFERENCE TO PRIOR APPLICATIONS

This is a continuation-in-part of application Ser. No. 578,530 filed May 19, 1975 for Combination Sight and Range Finder And Process of Sighting, now abandoned.

BACKGROUND OF THE INVENTION

This invention relates to new and useful improvements in an automatic distance compensating sight and to a process of sighting.

Many prior sighting devices and processes have heretofore been provided for weapons but the present device is believed to amount to a substantial improvement thereover. One disadvantage of prior devices used on archery bows, for example, is that it is necessary to go through more than one step for aiming and shooting, namely, one step may comprise determining the distance from the bow to the target and the other may comprise sighting in on the target as determined by such distance. In other prior art devices, while distance aiming designations may be printed on the sighting device, it is still necessary for the archer to know what the distance is. Such is usually accomplished by guesswork. In still other devices, it is necessary for the archer to look at a range finder and the target at the same time, thus making it difficult to accurately aim at the target.

SUMMARY OF THE INVENTION

According to the present invention and forming a primary objective thereof an automatic distance compensating sight is provided utilizing a lens through which the target is sighted and having a reference point and a refraction of the lens such that by selected aiming below the image in the lens the weapon is automatically positioned according to the distance to the target, such sighting and weapon positioning all being accomplished in one step.

The objectives of the invention are accomplished by an automatic distance compensating sight of the type described wherein the lens and reference point facilitate the use of a novel aiming process, namely, aiming is accomplished by placing the reference point a selected distance below the bottom of the image appearing in the lens, thus making the image of the animal come through a different part of the lens depending on the distance by using a lens structure which provides automatic aiming at the different distances. Such facilitates easier sighting and more accurate shooting than by any system or apparatus heretofore employed.

Another object of the invention is to provide an automatic distance compensating sight adaptable for use with substantially any type of archery bow and also capable of use with other weapons such as guns.

Yet another object is to provide an automatic distance compensating sight that is simplified in its operation so that the user can readily adapt to its association with the weapon and also to provide such a device which is simplified in construction and inexpensive to manufacture.

The invention will be better understood and additional objects and advantages will become apparent from the following description taken in connection with the accompanying drawings.

BRIEF DESCRIPTION OF THE DRAWINGS

FIG. 1 is a diagrammatic view of an archery bow and target as well as aiming and trajectory lines of an arrow to illustrate operation of the invention;

FIGS. 2, 3, 4 and 5 are diagrammatic views of the lens used with the present sight and showing bow positions and image sizes for targets in four different distances from the bow;

FIG. 6 is a diagrammatic side elevational view showing exemplary displaced or refracted lines of sight through the lens used with the invention;

FIG. 7 is a side elevational view, partly broken away, of a first form of sight for supporting the lens on an archery bow;

FIG. 8 is an enlarged vertical sectional view taken on the line 8—8 of FIG. 7;

DETAILED DESCRIPTION OF A PREFERRED EMBODIMENT

Figure 9:
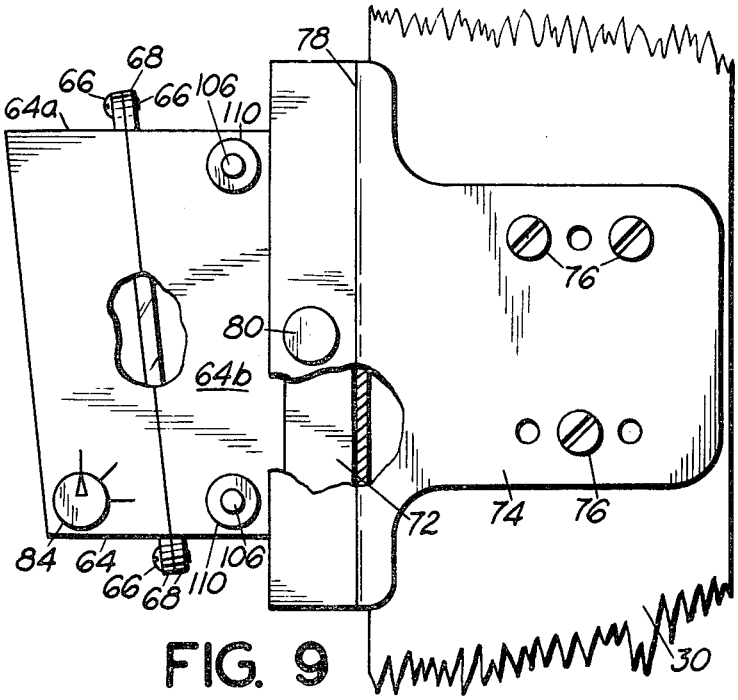
FIG. 9 is a side elevational view, partly broken away, showing a second form of sight for supporting the lens on a bow.
Figure 10:
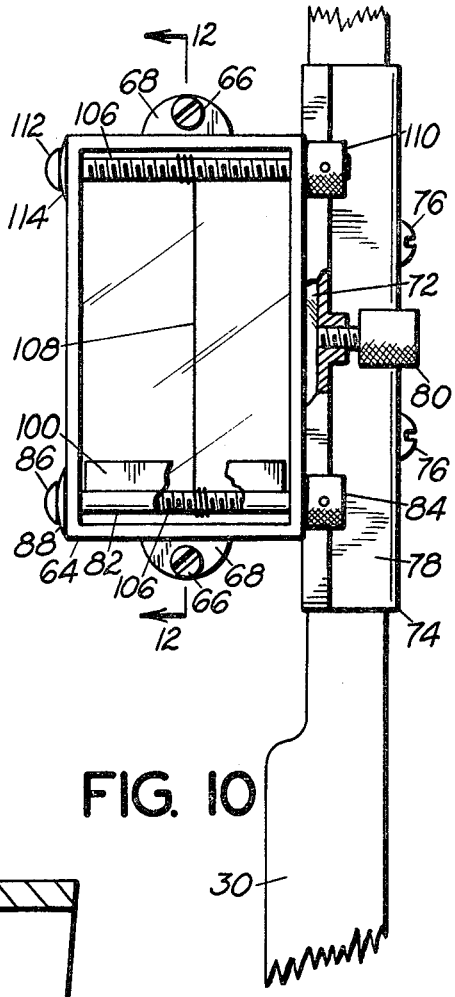
FIG. 10 is a front elevational view, partly broken away, of the sight of FIG. 9.
Figure 12:
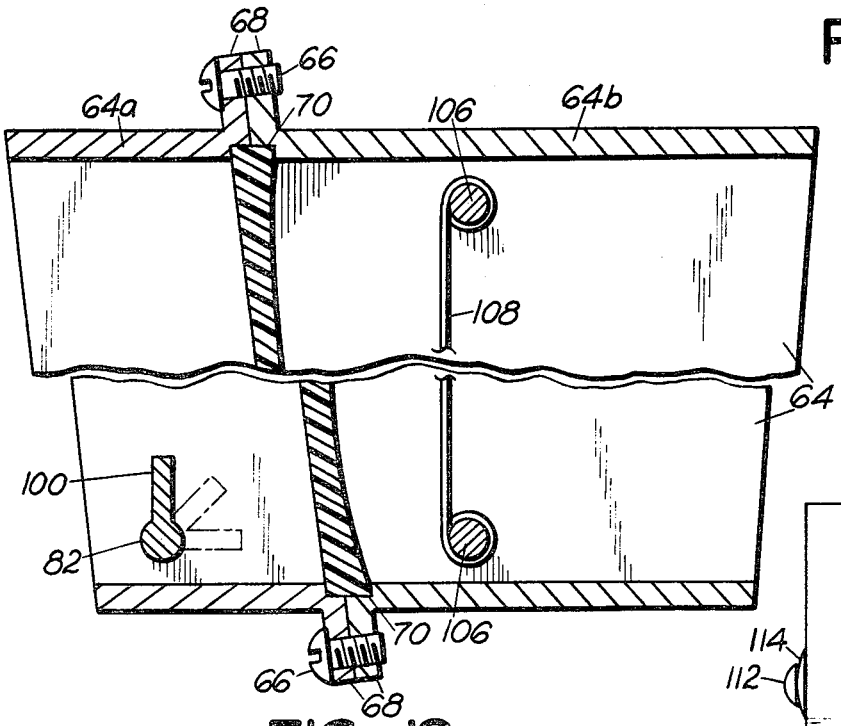
FIG. 12 is an enlarged fragmentary foreshortened sectional view taken on the line 12—12 of FIG. 10.
Figure 11:
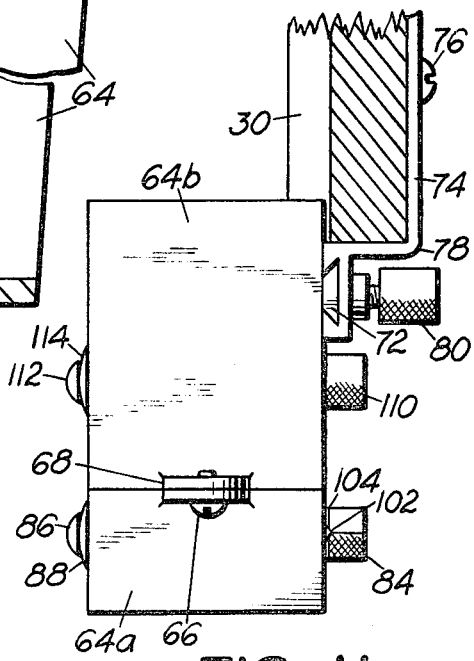
FIG. 11 is a top plan view thereof.

The present invention is illustrated herein for use in conjunction with an archery bow but it is to be understood that it can be used with any weapon that would require elevation adjustment according to the distance to the target or range. The invention utilizes a lens 10 through which the target is viewed and which is associated with a reference point and having a refraction, to be described, such that the bow is automatically raised or lowered according to the distance to the target.

With reference first to FIGS. 7 and 8, which show a first form of support means for the lens 10, channel-shaped side frames 12 and 14 are employed which have outwardly projecting stub shafts 16 intermediate their upper and lower ends supported in a housing 18. The shafts 16 have journaled support in opposite side walls 20 and 22 of the housing. The housing has a top wall 26 and a bottom wall 28, with forward and rearward ends thereof being open to allow viewing through the lens from right to left (as viewed in FIG. 7).

Housing 18 is secured on a bow 30 or other type of weapon by mounting screws 32 threadedly engaged with the bow and having head engagement with vertically elongated slots 34 in the wall 22. By means of such screw and slot mounting, the present device can be adjusted vertically for proper positioning on the bow. Removable plugs 36 are provided in the outer wall 20 aligned laterally with the screws 32 for convenience of access to the screws.

Lens 10 is held adjustably on its pivot supports 16 by an upper link 36 having a pivotal connection 38 with an upper portion of lens side frame 14. This link projects through an upper slot 40 in the top wall 26 of the housing 18 and has a threaded end portion 42 projecting through an upward extension 44 on the top wall 26 of the housing. Threaded end portion 42 of the link 36 has a slotted adjusting nut 46 engaged on opposite sides of extension 44, and by suitably threadedly positioning the nut 46, the lens can be rotatably positioned to the desired angle.

Mounted in the housing wall 22 adjacent to the lower end thereof is a sight pin 50 on the end of a screw 52 threadedly supported in wall 22 as by a nut 54 secured to the wall 22. Screw 52 has a knurled head 56 for hand adjustment. The sight pin comprises a reference point and its specific function will be made more apparent hereinafter.

Mounted at the rearward end of the housing 18 is a vertical prism member 60 which is provided for the purpose of offsetting the sighting device so that it will be disposed a sufficient distance above the arrow shelf, not shown, such that the arrow will clear the housing 18 without interference, and yet the line of sight through the lens is correct. Prism 60 is supported in a frame 62 secured to the interior of the housing 18. The use of the prism member 60 may or may not be necessary depending upon the type of weapon and possible interference of the sighting device with operation of the weapon and as will be more apparent hereinafter, it may be integrated with the lens.

With reference to FIG. 8, the lens is provided with index numerals 63 adjacent one edge thereof. These numerals commence with a first designation setting forth the recommended shooting limit of that particular sight, and other numerals are added therebelow which are beyond such shooting limit but of course within the over-all range of the weapon. If the bottom of the image appears in the area of the numerals 63, the archer can raise the bow a little in order to compensate for the shooting distance beyond the limitations of the sight. The farther down in the lens that the bottom of the image appears the more compensating upward positioning that should be made.

FIGS. 9–12 show a further form of sight for supporting the lens 10 and comprises a housing 64 open at the ends. The housing is formed of sections **64*a* and 64*b* removably attached together by screws 66 secured in adjacent ears 68. Upper and lower surfaces of the housing at the ear connections have grooves 70 for receiving the lens 10 and holding it in upright position. One side wall of the housing has a vertical tongue 72 engageable with a grooved bracket 74 arranged to be secured to a side of a bow 30, as by screws 76. The bracket is offset at 78 so that it can be secured to the far side of the bow relative to the arrow shelf and yet support the housing on the arrow shelf side. A setscrew 80 is threadedly mounted in the bracket and is engageable with tongue 72** for holding the housing at a desired vertical position on the bow.

A pin 82 extends across the housing at a lower and front portion thereof. This pin has a turning knob 84 on one projecting end thereof and a head 86 on the other projecting end backed by a spring washer 88 for holding the pin in a rotated set position. A tab 100 projects radially from the pin and preferably extends substantially the full length thereof. Such tab has at least three rotated reference positions with the pin as shown in full and broken lines in FIG. 12. The purpose of the tab 100 and positions thereof will become more apparent hereinafter. To maintain the pin positively in any one of its positions, the inner side of turning knob 84 has selectively placed notches 102 engageable with projection 104 on the housing, the knob being held in such positions, but forcibly adjustable, by the spring washer 88.

Upper and lower threaded rods 106 are mounted crosswise in the housing rearward of the lens and have the opposite ends of an upright wire member 108 wound thereon such that upon rotation of the rods the wire member can be adjusted laterally to selected positions between the sides of the housing for a reason which will become apparent hereinafter. Each rod 106 has a turning knob 110 on one projecting end thereof and a head 112 on the other projecting end backed by a spring washer 114 to restrain rotation of the rods.

The particular refraction of the lens 10 comprises an important part of the invention, together with the concept of utilizing a lower reference point, comprising the sight pin 50 in the embodiment of FIGS. 7–8 or the tab 100 in the embodiment of FIGS. 9–12, and a further concept of using the reference point to sight in on the target by aiming a selected distance below the image appearing in the lens. For purposes of this description and as will become more apparent hereinafter reference will be made to a deer as the animal being hunted. In this instance, the distance aimed below the image is one body depth.

Figure 13:
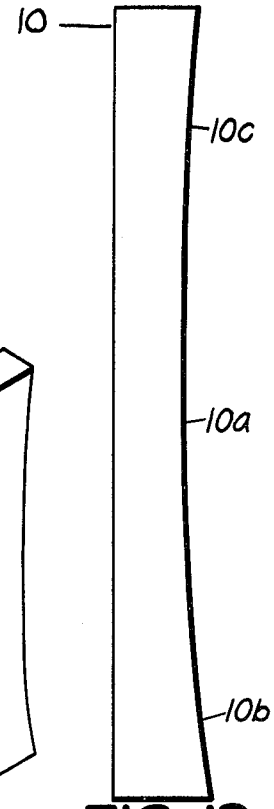
FIG. 13 is a side elevational view of a lens used with the invention and illustrating a first lens formula.
Figure 15:
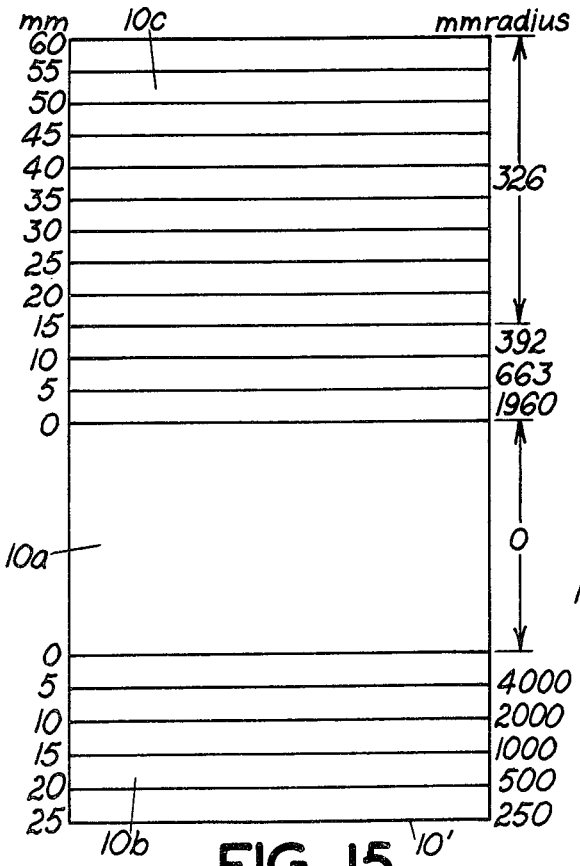
FIG. 15 is a face view of a lens using a slightly different formula.
Figure 14:
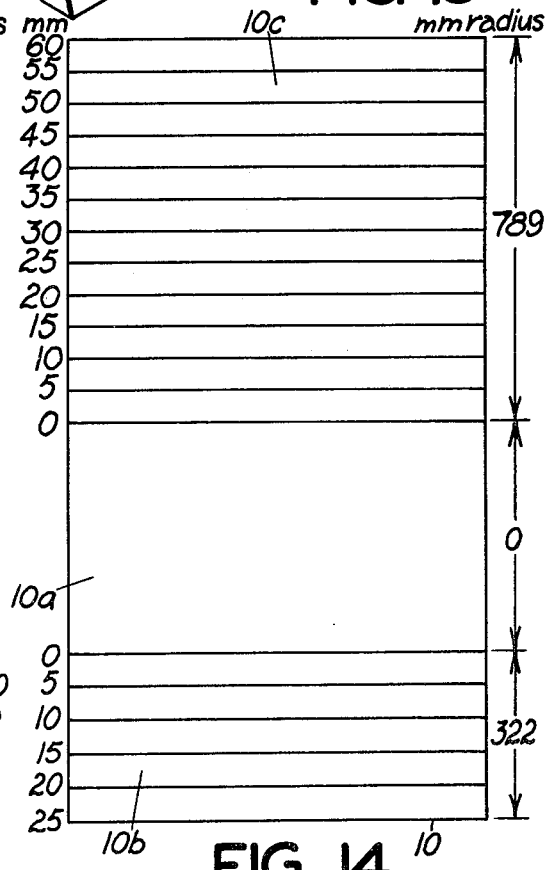
FIG. 14 is a face view of the lens of FIG. 13.

The aiming concept is achieved by the construction or formula of the lens 10 wherein image portions appearing at lower parts thereof are displaced up and image portions appearing at upper parts thereof are displaced down. An intermediate portion of the lens does not distort the image, namely, such portion appears substantially as clear glass or zero power. Representative formulae for the lens are illustrated in FIGS. 13–15 and will be discussed in detail hereinafter.

A diagrammatic representation of a lens used with the invention is illustrated in FIG. 6 wherein three lines a, b, and c represent image lines respectively through a central portion of the lens, through a lower portion thereof, and through an upper portion thereof. For purposes of illustration, the central portion of the lens is represented by the numeral **10*a*, the lower portion thereof is represented by the numeral 10*b*, and the upper portion thereof is represented by the numeral 10*c*. Thus, if the image of a deer appears in the central portion of the lens, it will not be displaced or distorted. However, as the image appears in the lower portion 10*b* of the lens, the deer, and mostly the brisket portion thereof, will be displaced upward. The image in the upper portion 10*c*** of the lens will be displaced downward, all for a purpose now to be described.

As stated above, the lens is used with the concept of aiming or offsetting one body depth below the deer, the body depth comprising that distance which appears in the lens between the top of the body along the back line and the bottom of the body along the brisket or stomach. Generally, aiming at the deer longitudinally is just behind the front shoulder. In explaining the present sighting device and process, it is apparent that the closer that the deer is to the archer the larger will be its image in the lens, and the farther the deer is from the archer the smaller will be its image in the lens. Also in explaining such device, reference is made to FIGS. 2, 3, 4 and 5 which show the lens 10 at different relative vertical heights as would occur from positioning the bow to hold the rerference point 50 of FIGS. 7–8 as illustrated in these views, or the reference point 100 of FIGS. 9–12 one body depth below the deer at different distances from deer to bow. A horizontal reference line 120 is used in association with these figures to compare the different lens and bow positions. Also, two lines 122 and 124 appear at the outer edges of each figure and represent the actual top and bottom of the deer, respectively, as would appear for example in the lens if no refractions were present. Lines 126 and 128 appearing within the lens illustrate the back line and bottom of the image of the deer, respectively, as seen through the lens.

The displacement or refraction lines 126 and 128 appear on the lines 122 and 124 in FIG. 4 since the image of the deer as represented by the lines 126 and 128 is within the clear glass portion of the lens and no displacement takes place. The archer in viewing the deer through the lens at this distance thus sees its true shape, and in the aiming process, the bow is positioned such that when the reference point 50 or 100 appears one body depth, namely, the distance between lines 126 and 128, below the bottom of the brisket, the arrow hits the center of the deer, or between lines 122–124. Reference is also made to FIG. 1 to illustrate this concept. The lower deer is the actual position of the deer and the upper one is as it appears in the lens. Line 120 comprises the reference line for hitting the deer and line 50 represents the reference point as positioned one body depth below the brisket as it appears in the lens.

Reference is now made to FIGS. 2, 3 and 5 to further explain the operation of the sight. FIG. 3 shows the height of the image (between lines 126 and 128) of the deer as it appears in the lens when it is at a greater distance from the archer than that shown in FIG. 4. At such distance, not only will the deer appear smaller than in FIG. 4 since it is farther away as illustrated by a comparison of the distance between lines 122 and 124 in the two figures, but also the bottom of its brisket will be displaced up, as designated by the lower line 128 in FIG. 3. At this distance, the upper line 126 will be at about the same height and not be displaced up. Thus, in aiming the bow, the archer places the reference point 50 or 100 one body depth below the deer as it appears in the lens, namely, the distance between the upper and lower lines 126 and 128, and since the vertical distance between the reference point and the bottom of the brisket as designated by the bottom line 128 comprises a shorter distance than that illustrated in FIG. 4, for example, the archer in order to aim one body depth below the deer, such body depth now being a lesser vertical distance, will automatically raise the bow, thereby compensating for the additional drop in the arrow due to the greater distance to the deer.

With reference now to FIG. 2, the animal is even farther away than in FIG. 3. In this situation, both the brisket and back appear in the lower portion of the lens and are displaced up, as designated by the two lines 126 and 128 in FIG. 2, and since these lines are moved up, the archer in aiming one body depth below the brisket must further raise the bow, thereby compensating for the additional drop in the arrow due to the greater distance to the deer.

For close in shots, namely, at distances closer than that illustrated in FIG. 4, such as illustrated in FIG. 5, the process of aiming one body depth below the deer corrects too much and under shooting may result. Such is the reason that the present lens is constructed so that its upper portion displaces the image downwardly. More particularly, as the deer is closer than that shown in FIG. 4, the height of the image, namely, the distance between lines 126 and 128 is minimized relative to its actual height (the distance between lines 122 and 124) so that in aiming one body depth below the deer, the archer does not lower his bow as much as he would if he saw the true image of the deer as represented by lines 122–124, and therefore undershooting does not occur. The brisket line 124 will not vary vertically in these closer positions of the deer since it appears in the area of the unrefracted portion of the lens. The closer in that the deer is the larger will he appear as shown by lines 122 and 124, therefore making his back come through in a higher part of the lens. Thus, there will be a greater correction to prevent undershooting due to the progressive displacement of his back in a downward direction.

According to the invention, the archer can readily view the deer in the lens and at the same time take his aim one body depth below the bottom of the brisket. The archer does not have to guess at the target distance since such is provided automatically by the lens. In addition, he does not have to go through a series of steps before shooting but merely places the reference point 50 or 100 one body depth below the deer as it appears in the lens. The bead end of reference point 50 in the embodiment of FIGS. 7–8 provides for vertical sighting alignment, and the wire 108 in the embodiment of FIGS. 9–12, adjusted laterally as desired, provides for similar vertical sighting alignment. The rotated adjustment of pin 82 adjusts the sight for different size animals wherein it is desired that the bow will be raised accordingly to strike the animal at the spot desired. Thus, with the lens arranged for deer hunting wherein the tab is vertically positioned for such hunting, the tab is adjusted to its horizontal position for elk and is adjusted to its intermediate position for medium size animals such as black bear.

The accuracy of the present aiming procedure is of course dependent upon initial proper positioning of the sighting device on the bow as accomplished by a suitable sighting in process to suit that particular bow archer.

Reference is made to FIGS. 13 and 14 to illustrate a lens formula which may be used to accomplish the invention. As was described hereinbefore, an intermediate portion which is identified by the reference numeral **10*a* is flat and thus does not displace the image. The lower portion 10*b* is constructed so that as stated it will refract the image upwardly. The upper portion 10*c* is constructed so that as stated it will refract the image downwardly. As to one particular formula which accomplishes the intended purpose, the lower portion 10*b* which extends 25 mm from the portion 10*a* to the bottom has a radius forming a cylindrical plane of approximately 322 mm. The upper portion 10*c* which extends 60 mm from the portion 10*a* to the top has a radius forming a cylindrical plane of approximately 789 mm. It is thus apparent that the displacement of the image in the upper and lower portions of the lens occurs for the purposes set forth and described in detail hereinfore. A lens including another illustrative formula is shown in FIG. 15, designated by the numeral 10'. This lens similarly has an intermediate flat portion 10*a* which does not displace the image. The lower portion 10*b* has radii (illustrated at increments of 5 mm) forming a spiral plane from the portion 10*a* to the bottom. The upper portion 10*c* from the flat portion 10*a* through the first 15 mm (illustrated at increments of 5 mm) has radii forming a spiral plane and the remainder of this portion has a radius forming a cylindrical plane. This lens makes the correct adjustment at all the necessary ranges of the weapon and somewhat more precise than the lens shown in FIG. 14**. It is to be understood that other lens formulae may be used such as those for example having parabolic or hyperbolic planes. The radii illustrated was calculated for plastic which has a refractory index of 1.490.

Figure 16:
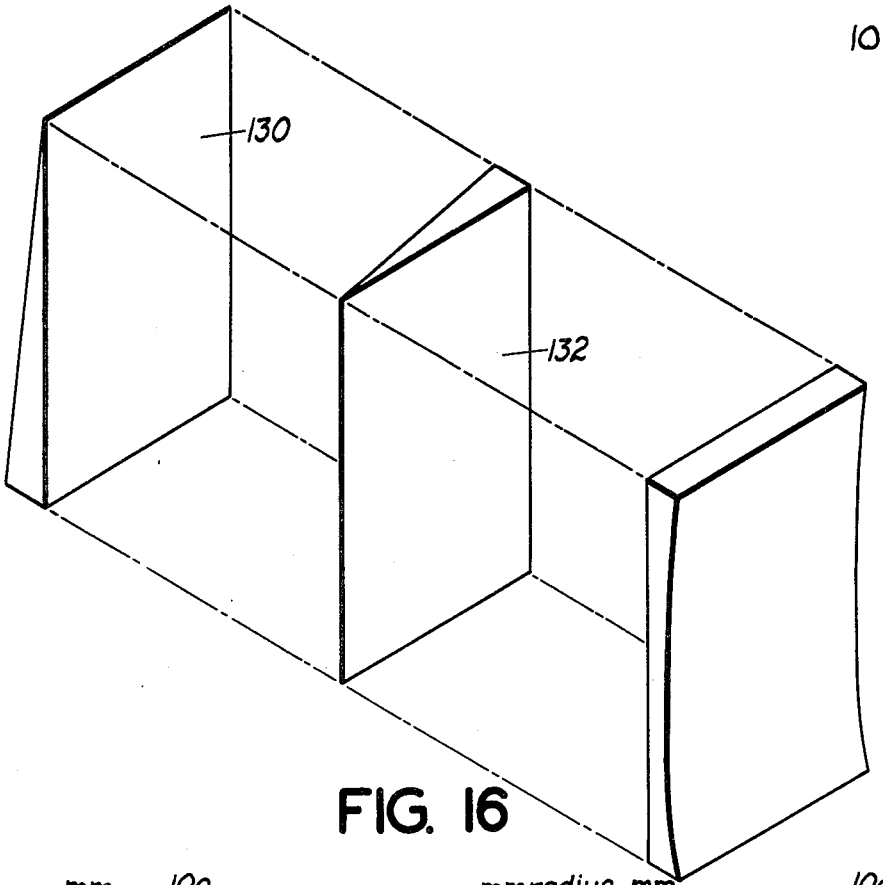
FIG. 16 is a perspective view of an assembly of a lens and a pair of prisms which may be used with the invention.

Lens 10 may be combined with prisms 130 and 132, FIG. 16, to facilitate mounting of the sight on the bow and to accomplish proper sighting. Lens 130 raises the image so that the sight will clear the arrow shelf and yet allow proper aiming at the one body depth below the image, and lens 132 centers the image against lateral offset mounting of the sight. The prisms 130 and 132 and lens 10 are preferably integrated into one unit.

It is to be understood that the forms of our invention herein shown and described are to be taken as preferred examples of the same and that various changes in the shape, size and arrangement of parts may be resorted to without departing from the spirit of our invention, or the scope of the subjoined claims.

Having thus described our invention, we claim:

1. An automatic compensating sight for weapons comprising a support arranged to be secured to a weapon, a lens on said support, and a reference point on said support associated with said lens, the refraction of the lens being of predetermined arrangement such that image portions appearing at lower parts thereof are displaced up and image portions appearing at upper parts thereof are displaced down, an intermediate portion of said lens being zero power, whereby in placing the reference point a selected distance below a bottom line of the image of a target as viewed in the lens by movement of said support with the weapon, the weapon is properly aimed to automatically compensate for the flight of the projectile according to the distance between the weapon and the target.

2. The automatic distance compensating sight of claim 1 wherein said support includes a horizontal axis pivot support for said lens to adjust said lens relative to the vertical.

3. The automatic distance compensating sight of claim 2 including screw adjustment means between said support and said lens to selectively adjust said lens on said pivot axis.

4. The automatic distance compensating sight of claim 1 including a vertical prism member on said support providing vertical offset sighting through said lens.

5. The automatic distance compensating sight of claim 1 including a horizontal prism member on said support providing horizontal offset sighting through said lens.

6. The automatic distance compensating sight of claim 1 including a vertical prism member on said support providing vertical offset sighting through said lens, and also including a horizontal prism member on said support providing horizontal offset sighting through said lens.

7. The automatic distance compensating sight of claim 1 including laterally adjustable vertical aligning means associated with said lens.

8. A process of aiming a weapon at a target through a lens on the weapon of predetermined refraction such that image portions appearing at lower parts thereof are displaced up and image portions appearing at upper parts thereof are displaced down, an intermediate portion of said lens being of zero power, said process comprising the steps of sighting through the lens in association with a reference point on the weapon and moving the weapon so that a selected height of the image of the target as defined by upper and lower lines thereof in the lens is disposed above the reference point.

* * * * *